US005093558A

United States Patent [19]

Blystone et al.

[11] Patent Number: 5,093,558

[45] Date of Patent: Mar. 3, 1992

[54] INSULATOR SUPPORT CLIP, INSULATOR AND ASSEMBLY

[75] Inventors: Eugene E. Blystone, Savannah, Ga.; Dan W. Bogle, Murfreesboro, Tenn.; Van C. Jones, Murfreesboro, Tenn.; Jackie J. Bragg, Murfreesboro, Tenn.; Bill Sowder, Murfreessboro, Tenn.

[73] Assignee: Emerson Electric Co., St. Louis, Mo.

[21] Appl. No.: 499,008

[22] Filed: Mar. 26, 1990

[51] Int. Cl.[5] ..... H05B 3/06; H05B 3/64

[52] U.S. Cl. ..... 219/532; 174/158 R

[58] Field of Search ..... 219/532, 542, 536, 537; 174/138 J, 138 G, 175, 158 R; 338/317, 318, 321

[56] References Cited

U.S. PATENT DOCUMENTS

| | | | |
|---|---|---|---|
| 1,819,537 | 8/1931 | Berry | 338/317 |
| 3,697,727 | 10/1972 | Neuman et al. | 219/532 |
| 4,481,411 | 11/1984 | Roth | 219/532 |
| 4,528,441 | 7/1985 | Seal et al. | 219/532 |
| 4,675,511 | 6/1987 | Sherrill | 219/532 |
| 4,730,377 | 3/1988 | Sherrill | 219/532 |
| 4,857,707 | 8/1989 | Dall | 219/532 |

*Primary Examiner*—Geoffrey S. Evans

*Attorney, Agent, or Firm*—Polster, Lieder, Woodruff & Lucchesi

[57] ABSTRACT

An open coil electric heater (1) is disclosed having an open frame (3) and an exposed, open heating coil (11) of suitable resistance heating wire. The coil is supported on the frame by so-called "point suspension" electrical insulators (12). The insulators have a pair of apertures or holes (41) therethrough for receiving a pair of spaced arms (**45*a*, 45*b*) of a wire mounting clip (9**). The wire clip arms are crimped or are otherwise deformed adjacent the insulator so as to hold the insulator axially in place on the clip. The clip is welded to the frame.

4 Claims, 2 Drawing Sheets

INSULATOR SUPPORT CLIP, INSULATOR AND ASSEMBLY

BACKGROUND OF THE INVENTION

This invention relates to electrical resistance heaters, and more particularly to open coil heaters in which the heating element is formed of electrical resistance heating wire, of Nichrome or the like, and even more particularly in which the heating element is formed in a helical coil and is exposed to the air. The heating element is supported on a frame or the like by using ceramic-type insulators. Such heaters find a wide range of applications, for example, in electric clothes dryers, resistance heating systems for residential and in commercial heating and ventilating systems.

Open coil heaters have typically utilized two types of ceramic (steatite) insulators to support the heating coil on an open heater frame. As shown in prior U.S. Pat. Nos. as 1,154,417, 2,478,808, 2,478,809, 2,567,547, 2,730,603 and 3,016,441, and in Canadian Patent 554,732 bushing-type insulators having a central opening therethrough to receive the entire heater coil. The insulator, in turn, is supported on the heater frame by a metal strap, wire, or rod wrapped around the insulator and received in notches or a groove formed on the insulator. The support wire is welded to the heater frame. This manner of mounting the insulator has become known as "wire wrap" heater construction.

As shown in the co-assigned U.S. Pat. Nos. 3,846,619, Des. 248,943, 4,250,399, Des. 262,285, 4,472,624, and U.S. Pat. Nos. 4,268,742, 4,531,017, 4,617,547, 4,628,190 and 4,692,599 and in British Patent 1,003,610, another type of ceramic insulator, referred to as a "point suspension" type insulator, also came into use. These "point suspension" insulators have a variety of notches or slots which grip the heater coil at a point, rather than requiring the heater coil to be entirely inserted through the central opening of a bushing type insulator. This point suspension method of supporting a heater coil on an insulator facilitates ease of assembly of the heater (because the insulator does not have to be inserted through a series of bushing insulators) and results in cooler operation and a longer service life of the heater coil (because of better heat dissipation).

Such "point suspension" type open coil heating elements have been mounted on a heater frame in a variety of ways. As shown in the above mentioned U.S. Pat. Nos. 4,486,619, 4,250,399 and 4,268,472, the insulators are provided with apertures or grooves which receive a metal tab from an insulator support bar bent into the aperture or groove to hold the insulator on the heater frame. Further, as shown in British patent 1,003,610 and in U.S. Pat. Nos. 4,531,017 and 4,692,599, the previously discussed "wire wrap" support method can also be utilized to mount "point suspension" insulators on a heater frame. As shown in U.S. Pat. No. 4,472,624, point suspension insulators have been "twist lock" mounted in a sheet metal strap or bar having openings which allow the insulator to be readily inserted into the opening and then turned 90° to be locked into place.

Generally, the tab locked-in-place insulators, as shown in U.S. Pat. No. 4,250,339, are used in applications in which the generally flat point suspension insulator was oriented generally perpendicular to the axis of the heater coil. Wire wrap mounted point suspension insulators offer an inexpensive way to mount point suspension insulators in a wide range of applications. In other applications in which the point suspension insulator is oriented in line with the axis of the heater coil, wire wrap clips are used to mount the insulators on the heater frame. However, the insulators oftentimes tended to be loose within their wire wrap clips. In certain instances, this results in objectionable rattling noises emanating from the insulators which rattle within their wire wrap support clips during operation of an appliance (e.g., a clothes dryer) in which the heater is installed.

There is a need for a method of mounting point suspension insulators which combine the low cost and flexible design features of prior wire wrapped mounting techniques combined with the secure mounting of the insulators afforded by the bent tabbed mounting method.

SUMMARY OF THE INVENTION

Among the several objects and features of this invention may be noted the provision of an open coil heater in which "point suspension" type insulators may be readily and securely mounted on a wide variety of heater frame constructions;

The provision of such a heater in which a wide variety of "point suspension" insulator designs may be utilized;

The provision of such a heater in which the insulators may be readily and positively secured to their holders in such manner as to substantially eliminate the tendency of the insulators to rattle in their holder during operation of the heater or its application;

The provision of such a heater in which a single insulator or multiple insulators may be mounted on a single insulator support clip;

The provision of such are heaters in which a variety of insulator support clips may be used; and The provision of such a heater which is of simple and rugged construction, is easy to assemble, requires less labor to manufacture, has a long service life, and is readily field repairable.

In accordance with this invention, generally stated, an open coil electric resistance heater comprises a frame and a coil-type heating element. The heating element is formed by a length of suitable resistance wire wound into a coil and having a plurality of convolutions. A plurality of insulators of a suitable insulative material engage at least one of the coil convolutions thereby to grip the coil and electrically insulate the coil from the frame. Each insulator has at least one notch therein for receiving a coil convolution, and at least one mounting aperture extending through the body of the insulator. Insulators are mounted on the frame using a clip having a pair of spaced apart arms. The arms are insertable through the aperture in an insulator and twisted or crimped adjacent thereto. This substantially prevents axial movement of the insulator with respect to the clip. The clip is securable to the frame. A method of forming a heater is also described.

Other objects and features of this invention will be in part pointed out and in part apparent hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 6:
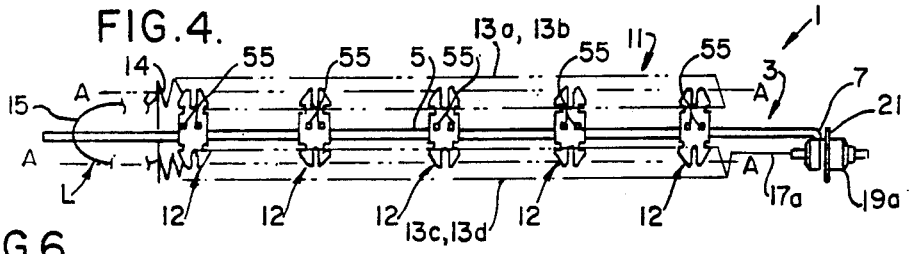
FIGS. 6 and 7 are respective side elevational and top plan views of a completed heater assembly utilizing a plurality of insulator assemblies, such as shown in FIGS. 3-5, to support runs of an electric heating coil.
Figure 7:
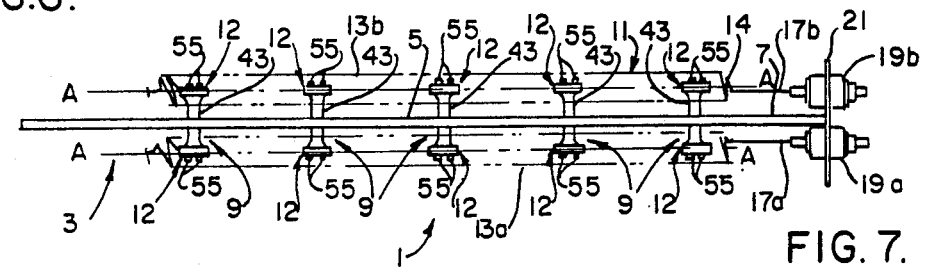
Figure 8:
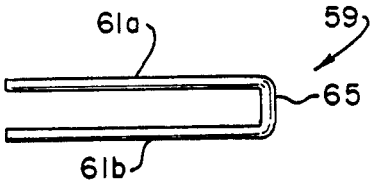
FIG. 8 is a top plan view of a second embodiment of a clip for use with the insulator.

Referring now to the drawings, an open coil electrical resistance heater in accordance with this invention is generally indicated by reference character 1 (see FIGS. 6 and 7). While those skilled in the art will appreciate that the broader aspects of this invention may be applied to virtually any type of electrical resistance heater using an elongate, coiled electric resistance heating element, heater 1 shown in the drawings and discussed herein is a heating element for a residential clothes dryer which is intended to be installed in a heater box (not shown) through which air is drawn, heated by the heating element, and discharged into the clothes drum for drying purposes.

More specifically, heater 1 includes a frame, as generally indicated at 3, having at least one rod 5 extending longitudinally of the frame and having an end 7 at each end thereof (only of which is shown in the drawings). As shown, frame 3 is constituted by a one-piece, rod having five support clips, as generally indicated at 9, extending transversely thereof supporting the heating element in a manner as will appear. Each support clip 9 is preferably formed of a weldable material and is secured at its middle to rod 5 by welding.

As generally indicated at 11, a heating element is mounted on the support clips 9 of frame 3 by means of so-called "point suspension" insulators 12 (see FIG. 1) so as to be open to the air. As is typical, heating element 11 is a continuous length of suitable electrical resistance heating wire, such as Nichrome or the like, and such as is well known to those skilled in the art. Heating element 11 has a plurality (e.g., four) heating element runs 13*a*–13*d* extending generally parallel to one another with two of the runs 13*a*–13*b* being located on one side of support clips 9 and with the other two runs 13*c*–13*d* being located on the other side of the clips. As shown, each of the runs is constituted by a longitudinal helical coil of the electrical resistance heating wire with the coil having a multiplicity of generally uniformly spaced convolutions 14 and having center helical axis, as indicated by A—A in FIGS. 6 and 7.

Each of the adjacent runs 13*a*–13*d* of the heating element 11 are electrically connected in series to an adjacent run of the coil by a so-called turnaround, as indicated at 15. More specifically, each of the turnarounds (only one of which is shown in the drawings) is not of helical coil construction, but rather has a defined length of heating element wire therein. Each turnaround includes a partially closed loop, as generally indicated at L, electrically connecting the end of one heating element run with the end of the next adjacent run. The turnarounds are in series with the runs, thereby to provide electrical continuity from one end of heating element 11 to the other. Construction of a partially closed loop L permits significant movement of adjacent heating element runs relative to one another upon firing and unfiring of the heater element and upon the circulation of air thereover. This movement occurs without placing undue strain on the heating element, particularly after it has been fired. Otherwise, the strain may cause premature failure of the heating element. Also, because of the open construction of the turnaround, it is exposed to air flowing over the heating elements. The various portions of the turnarounds are spaced relatively far from one another such that reradiation of radiant thermal energy from one portion of one turnaround to another does not cause excessive heating of the turnaround wires thereby to enhance the service life of heating element 11.

In addition to the helical coiled runs 13*a*–13*b* and the looped end turns 15, all as above described, heating element 11 also includes a pair of leads, 17*a*, 17*b*, integral with the heating elements. These leads constitute the ends of heating element 11 and are electrically connected to respective electrical terminals 19*a*, 19*b*. Those skilled in the art will recognize that the terminals 19*a*, 19*b* may be connected to a source of electrical power for energization of heating element 11 in the conventional manner. Further, frame 3 for heating element 1 comprises a terminal support bracket 21 which is secured to one end 7 of frame 3.

Figure 1:
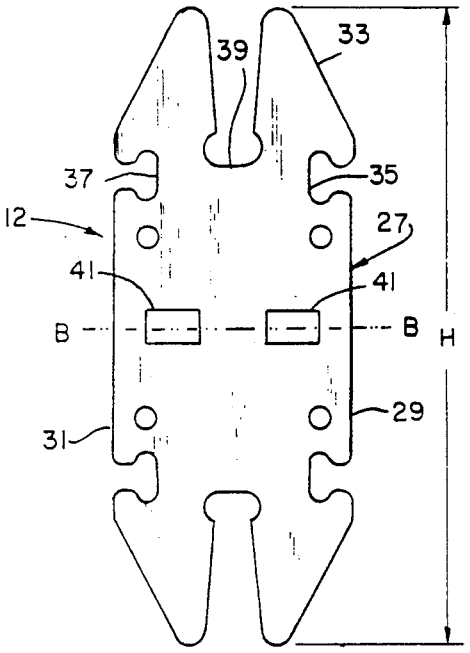
FIG. 1 is an elevational view of an insulator for use in an open coil electric resistance heater of the present invention.

As previously mentioned, runs 13*a*–13*d* of heating element 11 are supported on electrical and thermal insulators, each of which is generally indicated at 12, thereby to hold the heating element 11 clear of frame 3 and to support the heating element during energization. Each insulator 12 is a so-called "point suspension" insulator and is carried by a respective support clip 9. The insulator has the provision on both its upper and lower faces (as viewed in FIG. 1) of securing and supporting a respective run of heating element 11. This maximizes heat transfer from the convolutions of the heating element engageable with the insulator to, in turn, minimize the operating temperature of the portions of the heating coil supported by the insulator. Also, the insulator supports the heating coil in such a way as to minimize sag of the helical coil heating element extending between the insulators. As shown in FIG. 1, insulator 12 is double ended (i.e., generally symmetrical about an axis, or plane, as indicated by B—B). Thus, only the upper portion of the insulator shown in FIG. 1, will be described in detail. However, those skilled in the art will recognize that the bottom portion of the insulator is essentially identical and operates to support its respective heating element run in the same manner as will hereinafter be described. Of course, those skilled in the art will also recognize that insulators 12 may be single ended for supporting only a single heater element run. Further, while insulators 12 are herein shown and described as supporting an upper and a lower coil, the insulators 12 need not be vertically oriented and may support the heater runs to the side of the insulator, or at any other desired angle.

As is conventional, insulator 12 is preferably made of a ceramic-like material, for example steatite, so as to electrically insulate heating element 11 from frame 3 and also so as to thermally insulate the heating element and to prevent undue conduction of heat away from the portions of the heating element in contact with the insulator.

Figure 4:
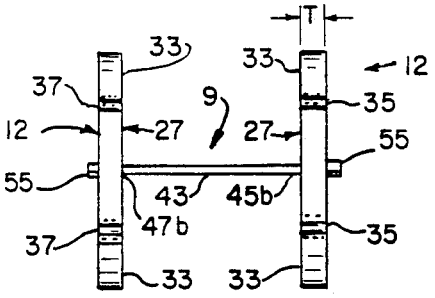

The insulator has a body 27 of the steatite material (or of other ceramic electrical insulative material) with the body having a width or thickness T, as shown in FIG. 4, and having an overall height, as indicated by dimension H in FIG. 1. As shown in FIG. 4, insulator 12 has a first side 29 (i.e., the right side as shown in FIG. 1) and a second side, as indicated at 31. Further, the insulator has an intermediate or top side 33 extending between the first and second sides. First side 29 has a blind notch, as indicated at 35, provided therein and side 31 has a similar respective notch 37 therein. The width of notches 35 and 37 is somewhat wider than the thickness of electrical resistance heating wire 11. Further, the upper or intermediate side 33 of the insulator is provided with an intermediate notch 39.

Figure 2:
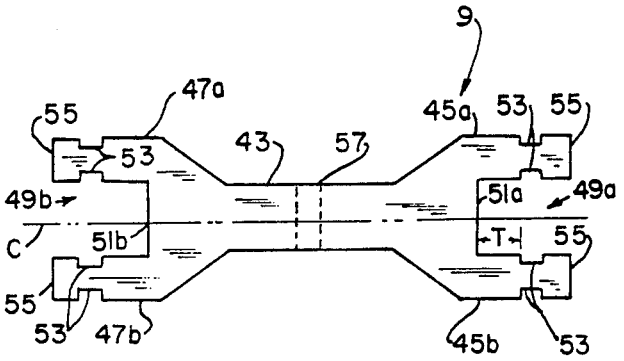
FIG. 2 is a top plan view of a first embodiment of a first clip for use with the insulator.

As shown in FIG. 1, insulator 12 has a pair of apertures or holes 41 therethrough. The holes are generally (but not necessarily) coincident with symmetrical axis B—B and the holes 41 are spaced apart from one another. Referring to FIG. 2, clip 9 has an elongate, flat main body section 43. A pair of spaced apart arms 45*a*, 45*b* extend outwardly from one end of the body, and a second pair of arms 47*a*, 47*b*, which are identical to the first pair, extend outwardly from the other end. Body 43 is rectangular in plan and the arms are formed so as to extend parallel to the longitudinal centerline C of the clip. The width of the arms corresponds to that of the apertures in an insulator 12 and the spacing between the arms of a respective pair corresponds to the distance between the apertures. Consequently, an insulator 12 is readily received on a clip. Each pair of arms further defines a three-sided U-shaped opening, 49*a* and 49*b*, respectively in which the body of an insulator is received. The inner end 51*a*, 51*b* of the opening is flat to form an abutting face 51*a*, 51*b* with the inner face of the insulator (when installed on the clip).

Figure 3:
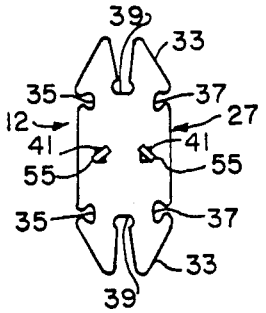
FIGS. 3, 4 and 5 are respective front elevational, side elevational and top plan views of an insulator assembly in which two insulators are mounted on the clip.
Figure 5:
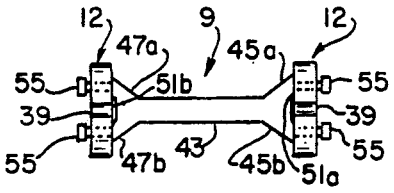

Each arm has a notch 53 formed in both its inner face and its outer face. The distance from the inner end 51*a*, 51*b* of each opening 49*a*, 49*b* to the inner edge of the notches is approximately equal to the thickness T of an insulator. The material from which the clip is formed is bendable as well as weldable. The notches 53 in each arm 47*a*, 47*b* form an area of reduced thickness. Thus, as shown in FIGS. 3–5, after an insulator is mounted on the arms, the outer ends 55 of the arms can be twisted or bent to lock the insulator in place. As the arms are twisted, the insulators are forced into firm abutting engagement with face 51*a*, 51*b* of the clip 9. Because of the spaced arms 47*a*, 47*b* being received in spaced holes 41 in insulator 12, the insulator is also prevented from rotating with respect to the clip when it is "twist locked" in place. As best shown in FIG. 3, the ends of the arms are, for example, turned or bent 30°–45° to lock an insulator in place.

Once the insulator assembly is fabricated, it mounted on the frame by being welded to rod 5. The shaded area 57 shown on clip 9 in FIG. 2 is generally the area where welding is done.

Figure 9:
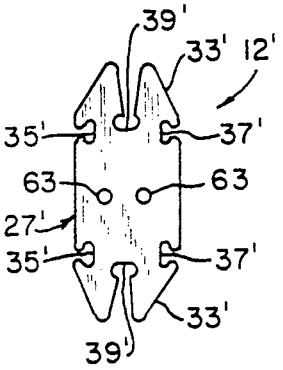
FIG. 9 is an elevational view of the insulator of FIG. 1 modified for use with the second clip of FIG. 8.
Figure 10:
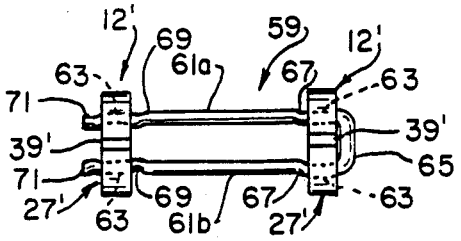
FIGS. 10 and 11 are respective top plan and side elevational views of an insulator assembly formed using the clip of FIG. 8.
Figure 11:
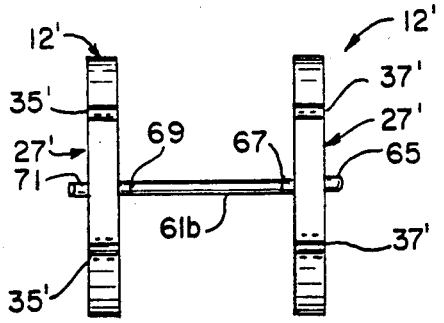

Referring to FIGS. 8–13, a second embodiment of the present invention utilizes a U-shaped clip 59 having spaced apart arms 61*a* and 61*b*. As seen in FIG. 9, an insulator 12' is similar in construction to insulator 12 previously described. Now, however instead of the rectangular apertures 41, insulator 12' has a pair of spaced apart circular apertures 63. Clip 59 is formed of a weldable, pliable wire and the diameter of openings 63 corresponds to that of the arms 61*a*, 61*b*.

Base 65 of clip 59 is generally at right angles to the respective arms for the outer face of an insulator 12' mounted on the clip to abut against the base of the clip. After installation, the arms are crimped, as indicated at 67, to lock the insulator in place. A second insulator 12' is then installed on the outer end of the clip. Arms 61*a*, 61*b* are then crimped at 69 and 71, on either side of the insulator, to lock this second insulator in place. The clip is then welded to the rod 5' (see FIGS. 12 and 13) during fabrication of the heater assembly.

Figure 12:
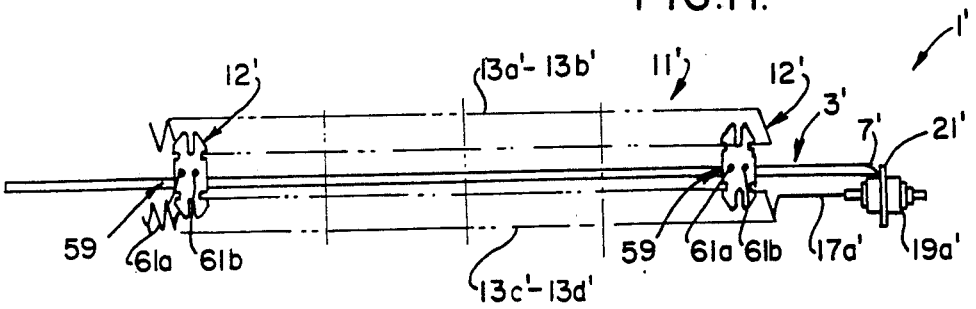
FIGS. 12 and 13 are respective side elevational views of a completed heater assembly utilizing a plurality of insulator assemblies such as shown in FIGS. 10-11 to support runs of an electric heating coil.
Figure 13:
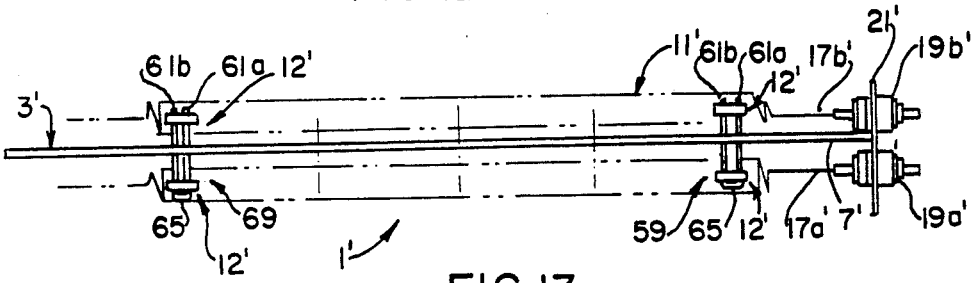

FIGS. 12 and 13 illustrate heater assembly 1' fabricated using clips 59 with insulators 12, The other components of the heater and these assembly are the same previously described for the prior embodiment of the invention.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. An open coil electric resistance heater comprising:

a frame;

a coil-type heating element comprising a length of suitable resistance wire formed into a coil with a plurality of convolutions;

a plurality of insulators of a suitable insulative material for engagement with at least one of the coil convolutions thereby to grip the coil and electrically insulate the coil from the frame, each insulator having at least one notch therein for receiving a coil convolution and a pair of spaced mounting apertures extending through the body and intermediate sides thereof; and, means for securing the insulators to the frame and including a U-shaped clip securable to the frame and having a pair of spaced apart arms each of which are insertable through the respective apertures in one of the insulators and securable thereto to substantially prevent axial movement of the insulator with respect to the clip, one said insulator being positioned on the clip adjacent the bore thereof wherein the length of the arms is such as to be insertable through the mounting apertures in a second insulator with the insulators being mounted on the clip in a spaced apart relationship.

2. The heater of claim 1 wherein the arms of the clip are crimped on each side of each insulator mounted of the arms thereby to lock the insulators on the clip and substantially prevent axial movement of each insulator with respect to the clip.

3. The heater of claim 2 wherein the clip is welded at a point intermediate its length to the frame.

4. An open coil electric resistance heater comprising:

a frame;

a coil-type heating element comprising a length of suitable resistance wire formed into a coil with a plurality of convolutions;

a plurality of insulators of a suitable insulative material for engagement with at least one of the coil convolutions thereby to grip the coil and electrically insulate the coil from the frame, each insulator having at least one notch therein for receiving a coil convolution and a pair of spaced mounting apertures extending through the body thereof and intermediate the sides thereof; and, means for receiving a pair of the insulators, one on each side of the frame, and including a clip having a clip body securable to the frame and a first pair of spaced apart arms extending from one end of the body and a second pair of spaced arms extending from the other end of the body, the respective arms of each pair of arms extending parallel to a longitudinal axis of the clip body, equidistantly therefrom and on opposite sides thereof, each pair of arms being insertable through the respective spaced pair of apertures in one of the insulators thereby to mount the insulators on the arms, the outer ends of the arms being twisted after their insertion through the apertures thereby to lock the insulator in place, and the body of the clip being welded to the frame to attach the clip thereto.

* * * * *